US010900099B2

(12) United States Patent
Ito et al.

(10) Patent No.: US 10,900,099 B2
(45) Date of Patent: Jan. 26, 2021

(54) STEEL H-SHAPE FOR LOW TEMPERATURE SERVICE AND MANUFACTURING METHOD THEREFOR

(71) Applicant: NIPPON STEEL & SUMITOMO METAL CORPORATION, Tokyo (JP)

(72) Inventors: Hidetoshi Ito, Tokyo (JP); Kazutoshi Ichikawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/079,265

(22) PCT Filed: Mar. 2, 2017

(86) PCT No.: PCT/JP2017/008275
§ 371 (c)(1),
(2) Date: Aug. 23, 2018

(87) PCT Pub. No.: WO2017/150665
PCT Pub. Date: Sep. 8, 2017

(65) Prior Publication Data

US 2019/0048435 A1 Feb. 14, 2019

(30) Foreign Application Priority Data

Mar. 2, 2016 (JP) ..... 2016-039957

(51) Int. Cl.
*C21D 9/00* (2006.01)
*C21D 8/00* (2006.01)
(Continued)

(52) U.S. Cl.
CPC ..... *C21D 9/0068* (2013.01); *C21D 1/60* (2013.01); *C21D 6/002* (2013.01); *C21D 6/005* (2013.01);
(Continued)

(58) Field of Classification Search
None
See application file for complete search history.

(56) References Cited

U.S. PATENT DOCUMENTS 5,743,972 A * 4/1998 Kimura ..... C21D 8/00 148/330
9,482,005 B2 * 11/2016 Mizoguchi ..... B21B 1/088
(Continued)

FOREIGN PATENT DOCUMENTS

CN 101883875 A 11/2010
EP 0 589 424 A2 3/1994
(Continued)

OTHER PUBLICATIONS

Machine translation of JP04-279248A. (Year: 1992).*
(Continued)

*Primary Examiner* — Xiaowei Su
(74) *Attorney, Agent, or Firm* — Birch, Stewart, Kolasch & Birch, LLP

(57) ABSTRACT

Provided is a steel H-shape for low temperature service including a predetermined chemical composition. A CEV obtained by CEV=C+Mn/6+(Cr+Mo+V)/5+(Ni+Cu)/15 is 0.40 or less. A sum of an area ratio of one or both of ferrite and bainite at a 1/4 position from an outer side across a thickness of a flange and a 1/6 position from an outer side across a flange width is 90% or more, and an area ratio of a hard phase is 10% or less. An effective grain size is 20.0 μm or less, and a grain size of the hard phase is 10.0 μm or less. 30 pieces/mm$^2$ or more Ti oxides having an equivalent circle diameter ranging from 0.01 to 3.0 μm are included. The thickness of the flange ranges from 12 to 50 mm.

4 Claims, 3 Drawing Sheets

(51) Int. Cl.

| | |
|---|---|
| ***C21D 6/00*** | (2006.01) |
| ***C22C 38/14*** | (2006.01) |
| ***C22C 38/12*** | (2006.01) |
| ***C22C 38/00*** | (2006.01) |
| ***C21D 8/02*** | (2006.01) |
| ***C22C 38/58*** | (2006.01) |
| ***C21D 1/60*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/16*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C21D 6/008* (2013.01); *C21D 8/00* (2013.01); *C21D 8/005* (2013.01); *C21D 8/0226* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/46* (2013.01); *C22C 38/48* (2013.01); *C22C 38/50* (2013.01); *C22C 38/58* (2013.01); *C21D 2211/002* (2013.01); *C21D 2211/005* (2013.01)

(56) References Cited

U.S. PATENT DOCUMENTS

| | | | | |
|---|---|---|---|---|
| 10,060,002 | B2 * | 8/2018 | Mizoguchi | C21C 7/06 |
| 2010/0258219 | A1 | 10/2010 | Ahn et al. | |
| 2010/0330387 | A1 * | 12/2010 | Yoshida | C21C 7/0006 428/577 |
| 2014/0301888 | A1 * | 10/2014 | Ichikawa | C22C 38/14 420/83 |
| 2016/0376675 | A1 * | 12/2016 | Mizoguchi | C21D 8/0226 428/598 |

FOREIGN PATENT DOCUMENTS

| | | | | |
|---|---|---|---|---|
| EP | 3085803 | A1 | | 10/2016 |
| EP | 3 133 181 | A1 | | 2/2017 |
| JP | 04279248 | A | * | 10/1992 |
| JP | 5-263182 | A | | 10/1993 |
| JP | 5-271754 | A | | 10/1993 |
| JP | 7-216498 | A | | 8/1995 |
| JP | 9-104944 | A | | 4/1997 |
| JP | 2000-45042 | A | | 2/2000 |
| JP | 2002-256341 | A | | 9/2002 |
| JP | 3472017 | B2 | | 12/2003 |
| JP | 2005-264208 | A | | 9/2005 |
| JP | 2005-272949 | A | | 10/2005 |
| JP | 2006-144087 | A | | 6/2006 |
| JP | 2006-249475 | A | | 9/2006 |
| JP | 2011-157573 | A | | 8/2011 |
| WO | WO 2013/089156 | A1 | | 6/2013 |
| WO | WO 2015/093321 | A1 | | 6/2015 |
| WO | WO 2015/159793 | A1 | | 10/2015 |

OTHER PUBLICATIONS

Chinese Office Action and Search Report, dated Mar. 20, 2019, for counterpart Chinese Application No. 201780012914.1, with an English translation.

International Search Report, issued in PCT/JP2017/008275, PCT/ISA/210, dated Jun. 6, 2017.

Notice of Allowance for JP 2018-503395 dated Jul. 24, 2018.

Written Opinion of the International Searching Authority, issued in PCT/JP2017/008275, PCT/ISA/237, dated Jun. 6, 2017.

Chinese Office Action and Search Report dated Aug. 30, 2019, for counterpart Chinese Application No. 201780012914.1, with partial English translation.

Extended European Search Report dated Sep. 26, 2019, for counterpart European Application No. 17760128.3.

Korean Office Action dated Aug. 19, 2019, for counterpart Korean Application No. 10-2018-7023882, with English translation.

* cited by examiner

* NUMERALS INDICATE LENGTHS BY UNIT OF mm

STEEL H-SHAPE FOR LOW TEMPERATURE SERVICE AND MANUFACTURING METHOD THEREFOR

TECHNICAL FIELD OF THE INVENTION

The present invention relates to a steel H-shape for low temperature service used as a structural member or the like of a building used in a low-temperature environment, and a manufacturing method therefor. Priority is claimed on Japanese Patent Application No. 2016-039957, filed on Mar. 2, 2016, the content of which is incorporated herein by reference.

RELATED ART

Recently, construction of related facilities entailing resource development in cold regions is increasing. It is necessary for structures built in such cold regions to use a steel H-shape having excellent low temperature toughness.

In response to such a demand, for example, in Patent Documents 1 to 3, a method in which toughness of a steel H-shape is enhanced by refining a metallographic structure has been proposed. In the method, oxides which become a nucleation site of ferrite are utilized, and accelerated cooling is performed after hot rolling in order to suppress grain growth of ferrite.

According to Patent Documents 1 to 3, it is possible to obtain a steel H-shape exhibiting excellent Charpy absorbed energy at −5° C. or −10° C. However, recently, low temperature toughness (for example, toughness at −40° C.) required to steel H-shapes used a cold region has not been sufficient.

In addition, for example, Patent Document 4 has proposed a steel H-shape having the Charpy absorbed energy equal to or greater than 27 J at −40° C. and excellent low temperature toughness. In Patent Document 4, the C content or the nitrogen content (amount of solute N), which is solid-solubilized in a steel, is reduced without adding Nb, V, or the like, and the low temperature toughness of a steel H-shape is improved by applying accelerated cooling.

However, in Patent Document 4, although toughness of a base metal is evaluated, low temperature toughness of a welded heat-affected zone is not taken into consideration. In Patent Document 4, N is fixed by Ti, TiN is generated, and the amount of solute N is reduced. However, if a steel is heated to 1,400° C. or higher through welding, TiN is solid-solubilized in the steel. As a result, it is concern that a coarse structure is generated in a heat affected zone, particularly in the vicinity of a fusion line (FL). That is, in a case where TiN is formed and the amount of solute N is reduced as in Patent Document 4, although there is a certain effect of improving toughness of a base metal, there is a concern that low temperature toughness is degraded in a welded heat-affected zone (HAZ).

PRIOR ART DOCUMENT

[Patent Document]

[Patent Document 1] Japanese Unexamined Patent Application, First Publication No. H5-263182

[Patent Document 2] Japanese Unexamined Patent Application, First Publication No. H5-271754

[Patent Document 3] Japanese Unexamined Patent Application, First Publication No. H7-216498

[Patent Document 4] Japanese Unexamined Patent Application, First Publication No. 2006-249475

DISCLOSURE OF THE INVENTION

Problems to be Solved by the Invention

The present invention has been made in consideration of the foregoing circumstances, and an object thereof is to provide a steel H-shape for low temperature service, in which while strength required for a structural member is ensured, low temperature toughness of not only a base metal but also a welded heat-affected zone is improved, and a manufacturing method therefor.

Means for Solving the Problem

Nb is an element generating precipitates, such as carbides and nitrides, and is an element which adversely affects toughness in general and of which the amount is thereby limited as in Patent Document 4. However, Nb is an element suppressing recrystallization and contributing to grain refinement and is an element useful for an enhancement of strength. Therefore, the inventors have attempted to ensure strength and toughness of a steel H-shape by containing Nb and applying accelerated cooling.

As a result of investigation, the inventors have found that in a case where Nb is contained, low temperature toughness can be ensured by increasing a cooling rate of the accelerated cooling and promoting refinement of a structure. In addition, it has been found that the amount of an alloying element for enhancing hardenability can be reduced by performing the accelerated cooling so that, as a result, generation of a hard phase can be suppressed and low temperature toughness of a base metal can be ensured.

Moreover, the inventors have found that the structure in the vicinity of FL is refined and low temperature toughness of a HAZ is improved by causing Ti oxide (generic name for TiO, $TiO_2$, and $Ti_2O_3$, and is sometimes called $TiO_X$), which becomes a nucleation site for intragranular ferrite in a steel, to precipitate. Specifically, it has been found that since $TiO_X$ refines coarse austenite in the vicinity of FL by generating intragranular ferrite, generation of intergranular ferrite or coarse bainite is suppressed and low temperature toughness of the HAZ is improved.

On the other hand, it has been found that in a case where $TiO_X$ is utilized, TiN in a steel is reduced and initial austenite is likely to be coarse, thereby resulting in a problem of degradation of toughness of a base metal due to the formed coarse structure. In regard to this problem, the inventors have newly found that low temperature toughness of a base metal can be ensured by strictly controlling conditions for accelerated cooling after hot rolling.

The present invention has been made based on the knowledge described above, and the gist thereof is as follows.

(1) According to an aspect of the present invention, there is provided a steel IH-shape for low temperature service including, by mass %, C: 0.03% to 0.13%, Mn: 0.80% to 2.00%, Nb: 0.005% to 0.060%, Ti: 0.005% to 0.025%, O: 0.0005% to 0.0100%, V: 0% to 0.08%, Cu: 0% to 0.40%, Ni: 0% to 0.70%, Mo: 0% to 0.10%, Cr: 0% to 0.20%, Si: limited to 0.50% or less, Al: limited to 0.008% or less, Ca: limited to 0.0010% or less, REM: limited to 0.0010% or less, Mg: limited to 0.0010% or less, N: limited to 0.0120% or less, and a remainder including of Fe and impurities. A CEV obtained by the following Expression (a) is 0.40 or less. The sum of an area ratio of one or both of ferrite and bainite at a ¼ position from an outer side across a thickness of a flange and a ⅙ position from an outer side across a flange width is 90% or more, and the area ratio of a hard phase is 10% or less. The effective grain size is 20.0 μm or less, and the grain size of the hard phase is 10.0 μm or less. 30 pieces/mm$^2$ or more Ti oxides having an equivalent circle diameter ranging from 0.01 to 3.0 μm are included. The thickness of the flange is 12 to 50 mm.

$$CEV=C+Mn/6+(Cr+Mo+V)/5+(Ni+Cu)/15 \quad (a)$$

here, C, Mn, Cr, Mo, V, Ni, and Cu each indicate an amount of the element by mass %.

(2) The steel H-shape for low temperature service according to (1) may include, by mass %, one or two or more selected from the group consisting of V: 0.01% to 0.08%, Cu: 0.01% to 0.40%, Ni: 0.01% to 0.70%, Mo: 0.01% to 0.10%, and Cr: 0.01% to 0.20%.

(3) According to another aspect of the present invention, there is provided a method of manufacturing the steel H-shape for low temperature service according to (1) or (2). The method of manufacturing the steel H-shape for low temperature service includes melting a steel including the same chemical composition as that of the steel H-shape for low temperature service according to (1) or (2), casting the steel obtained through the melting to obtain a slab, heating the slab to a temperature ranging from 1,100° C. to 1,350° C., and then performing hot rolling at a finishing temperature ranging from ($Ar_3$-30°) C to 900° C. to obtain a steel H-shape, performing an accelerated cooling of the steel H-shape, in which inner and outer surfaces of a flange are subjected to water cooling at a cooling rate exceeding 15° C./sec. In the melting, Ti is added after oxygen concentration of a molten steel immediately before addition of the Ti is adjusted to a range from 0.0015 to 0.0110 mass %. In the accelerated cooling, the water cooling is performed such that a cooling stop temperature at a ⅙ position from an outer side across a flange width of the steel H-shape is 300° C. or lower at a surface temperature, and a maximum temperature of the surface temperature after recuperating is 350° C. to 700° C.

Effects of the Invention

According to the aspects of the present invention, it is possible to obtain a steel H-shape (steel H-shape for low temperature service) in which while strength is ensured without containing a large amount of an expensive element, a base metal and a welded heat-affected zone exhibit excellent toughness at a low temperature, such as −40° C. or −60° C., and a critical CTOD value, which is stricter toughness evaluation, is 0.40 mm or greater at −20° C. Therefore, according to the aspects of the present invention, industrial contribution is extremely remarkable, for example, reliability of a building or the like built in a cold region is improved without impairing economic efficiency.

EMBODIMENT OF THE INVENTION

Figure 1:
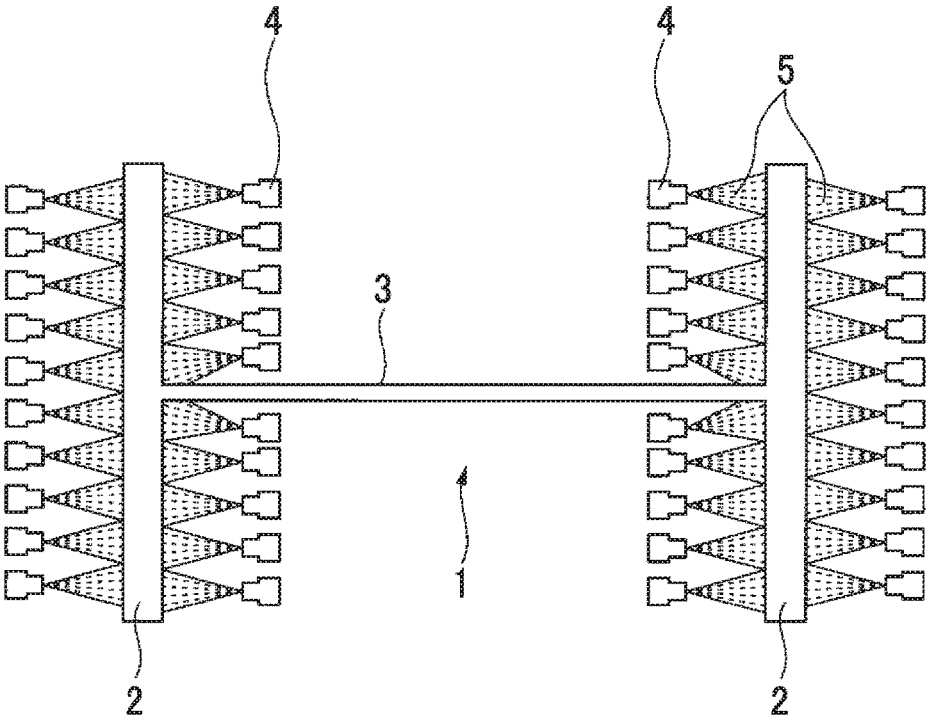
FIG. 1 is a view showing a cooling device (full face water cooling device) for cooling a steel H-shape after rolling.

According to an embodiment of the present invention, there is provided a steel H-shape for low temperature service (which may hereinafter be referred to as a steel H-shape according to the present embodiment) including a predetermined chemical composition. In the steel H-shape according to the present embodiment, at a ¼ position from an outer side across a thickness of a flange and a ⅙ position from an outer side across a flange width, the sum of the area ratio of one or both of ferrite and bainite is 90% or more, and the area ratio of a hard phase is 10% or less. The effective grain size is 20.0 μm or less, and the grain size of the hard phase is 10.0 μm or less. 30 pieces/mm$^2$ or more Ti oxides having an equivalent circle diameter ranging from 0.01 to 3.0 μm are included. The thickness of the flange ranges from 12 to 50 mm.

Hereinafter, the steel H-shape for low temperature service according to the present embodiment will be described.

First, the composition (chemical composition) of the steel H-shape for low temperature service according to the present embodiment and reasons for the limitation thereon will be described. Hereinafter, the unit % related to the chemical composition denotes mass % unless otherwise stated.

(C: 0.03% to 0.13%)

C is an element effective in strengthening a steel. In order to achieve this effect, the C content is set to 0.03% or more. The C content is preferably 0.04% or more and is more preferably 0.05% or more. If the C content exceeds 0.13%, martensite-austenite constituent (MA) and pseudo-pearlite, which are hard phase, increase, and toughness of a base metal and a welded heat-affected zone is degraded. Therefore, the C content is set to 0.13% or less. The C content is preferably set to 0.10% or less and is more preferably set to be less than 0.08%.

(Mn: 0.80% to 2.00%)

Mn is an element increasing strength of a steel and is effective in refining the effective grain size. In order to achieve these effects, the Mn content is set to 0.80% or more. The Mn content is preferably 1.00% or more, is more preferably 1.20% or more, and still more preferably 1.30% or more. If the Mn content exceeds 2.00%, toughness of the base metal and the welded heat-affected zone is degraded due to an increase in inclusion, or the like. Therefore, the Mn content is set to 2.00% or less. The Mn content is preferably 1.80% or less.

(Nb: 0.005% to 0.060%)

Nb is an element refining ferrite and increasing strength and toughness of a steel. Particularly, in the steel H-shape for low temperature service according to the present embodiment, the C content and the Si content are limited in order to ensure low temperature toughness of the base metal and the welded heat-affected zone. Therefore, strength is effectively ensured by containing Nb. In order to achieve these effects, the Nb content is set to 0.005% or more. The Nb content is preferably 0.010% or more. If the Nb content exceeds 0.060%, an increase in hard phase and/or an enhancement of hardness is caused in accordance with improvement of hardenability, so that toughness is degraded. Therefore, the Nb content is set to 0.060% or less. The Nb content is more preferably 0.050% or less.

(Ti: 0.005% to 0.025%)

Ti is an element necessary to form Ti oxides which become nucleation of ferrite. In order to achieve this effect, the Ti content is set to 0.005% or more. The Ti content is preferably 0.010% or more. If the Ti content exceeds 0.025%, coarse TiN or coarse TiC increases and becomes an origin of a brittle fracture. Therefore, the Ti content is limited to 0.025% or less. The Ti content is preferably 0.020% or less.

(O: 0.0005% to 0.0100%)

O is an element forming Ti oxides. In order to sufficiently generate Ti oxides, the O content is set to 0.0005% or more. The O content is preferably 0.0010% or more, is more preferably 0.0015% or more, and is still more preferably 0.0020% or more. If the O content becomes excessive, coarse oxides are generated, so that toughness is degraded. To suppress generation of coarse oxides and to ensure toughness, the O content is limited to 0.0100% or less. The O content is preferably 0.0070% or less and is more preferably 0.0050% or less.

(Si: 0.50% or less)

Si is a deoxidizing element, and the element also contributes to increase of strength. However, similar to C, Si is an element generating a hard phase. If the Si content exceeds 0.50%, toughness of the base metal and the welded heat-affected zone is degraded due to generation of the hard phase. Therefore, the Si content is limited to 0.50% or less. The Si content is preferably 0.30% or less, is more preferably 0.20% or less, and is still more preferably 0.10% or less. The lower limit for the Si content is not regulated and may be 0%. However, since Si is a useful deoxidizing element, in order to achieve this effect, the lower limit thereof may be set to 0.01% or more.

(Al: 0.008% or less)

Al is a deoxidizing element having higher oxide generation ability than T, and the amount of the element ought to be limited in a case where Ti oxides are to be sufficiently generated. If the Al content exceeds 0.008%, Ti oxides which will become nucleation of ferrite are inhibited from being generated due to generation of Al oxides. Therefore, the Al content is limited to 0.008% or less. The Al content is preferably 0.005% or less and is more preferably 0.002% or less. The lower limit for the Al content is not regulated and may be 0%.

(REM: 0.0010% or less)

(Ca: 0.0010% or less)

(Mg: 0.0010% or less)

Similar to Al, since all of REM (rare earth element), Ca, and Mg are elements having higher oxide generation ability than Ti, and the amounts of the elements ought to be limited. If the amounts of REM, Ca, and Mg exceed 0.0010%, Ti oxides which will become nucleation of ferrite are greatly inhibited from being generated. Therefore, the amount of each of REM, Ca, and Mg is limited to 0.0010% or less. The amounts of the REM, Ca, and Mg are preferably 0.0005% or less. The REM content, the lower limits for the Ca content and the Mg content are not regulated and may be 0%.

(N: 0.0120% or less)

N is an element degrading toughness of the base metal and the welded heat-affected zone. If the N content exceeds 0.0120%, low temperature toughness is remarkably degraded due to an increase in solute N and forming of coarse precipitates. Therefore, the N content is limited to 0.0120% or less. The N content is preferably set to 0.0100% or less and is more preferably set to 0.0070% or less. The N content may be 0%. However, if the N content is intended to be reduced to less than 0.0020%, the steel manufacturing cost increases. Accordingly, the N content may be 0.0020% or more. From a viewpoint of the cost, the N content may be 0.0030% or more.

The steel H-shape for low temperature service according to the present embodiment basically includes the elements described above and a remainder including of Fe and impurities. However, in place of a part of Fe, in order to increase strength and toughness, one or two more or selected from the group consisting of V, Cu, Ni, Mo, and Cr may be further contained. However, since these elements are optional elements which are not necessarily contained, the lower limit therefor is 0%. In addition, even if these optional elements are contained less than an amount within the range described below, they are acceptable because they do not inhibit characteristics of the steel H-shape for low temperature service according to the present embodiment. In addition, impurities are components which are incorporated from raw materials such as ores, scraps, and the like when a steel is industrially manufactured, or from various environments in manufacturing steps. The impurities denote that which are allowed to be contained within a range not adversely affecting the steel.

(V: 0.01% to 0.08%)

V is an element forming nitrides (VN) and enhancing strength of a steel. In a case where this effect is to be achieved, the V content is preferably set to 0.01% or more. The V content is more preferably 0.02% or more and is still more preferably 0.03% or more. Since V is an expensive element, even in a case of being contained, the upper limit for the V content is preferably 0.08%.

(Cu: 0.01% to 0.40%)

Cu is an element contributing to increase of strength. In a case where this effect is to be achieved, the Cu content is preferably set to 0.01% or more. The Cu content is more preferably 0.10%. If the Cu content exceeds 0.40%, strength excessively rises and low temperature toughness is degraded. Therefore, even in a case of being contained, the Cu content is set to 0.40% or less. The Cu content is preferably 0.30% or less and is more preferably 0.20% or less.

(Ni: 0.01% to 0.70%)

Ni is an element extremely effective in enhancing strength and toughness. In a case where these effects are to be achieved, the Ni content is preferably set to 0.01% or more. The Ni content is more preferably 0.10% or more and is still more preferably 0.20% or more. Since Ni is an expensive element, even in a case of being contained, in order to suppress a rise in alloying cost, the Ni content is preferably set to 0.70% or less. The Ni content is more preferably 0.50% or less.

(Mo: 0.01% to 0.10%)

Mo is an element contributing to increase of strength. In a case where this effect is to be achieved, the Mo content is preferably set to 0.01% or more. If the Mo content exceeds 0.10%, precipitation of Mo carbides ($Mo_2C$) or generation of a hard phase is promoted, so that toughness of the welded heat-affected zone may deteriorate. Therefore, even in a case of being contained, the Mo content is preferably set to 0.10% or less. The Mo content is more preferably 0.05% or less.

(Cr: 0.01% to 0.20%)

Cr is also an element contributing to increase of strength. In a case where this effect is to be achieved, the Cr content is preferably set to 0.01% or more. If the Cr content exceeds 0.20%, carbides are generated, so that toughness may be degraded. Therefore, even in a case of being contained, the Cr content is preferably set to 0.20% or less. The Cr content is more preferably 0.10% or less.

(P, S)

The amounts of P and S which are unavoidably contained as impurities are not particularly limited. However, P and S ought to be reduced as much as possible because they will cause a weld crack due to solidifying segregation, and degradation of toughness. The P content is preferably limited to 0.020% or less and is more preferably limited to 0.002% or less. In addition, the S content is preferably limited to 0.002% or less.

(CEV: 0.40 or less)

As described above, the steel H-shape for low temperature service according to the present embodiment is acceptable in both the case where the base elements are contained and the remainder of Fe and impurities, and the case where the base elements and optional elements are contained and the remainder of Fe and impurities.

Moreover, in the steel H-shape for low temperature service according to the present embodiment, in addition to the amount of each element, the CEV calculated from the amount of each element needs to be set to 0.40 or less.

The CEV is an index of hardenability and is preferably enhanced in order to ensure predetermined strength. However, if the CEV exceeds 0.40, toughness of a weld is degraded. Therefore, the CEV is set to 0.40 or less. If the CEV is reduced, there is concern that hardenability is degraded and the structure becomes coarse. Accordingly, the CEV is preferably set to 0.20 or greater.

The CEV can be obtained by the following Expression (1). In the following Expression (1), C, Mn, Cr, Mo, V, Ni, and Cu each indicate an amount of the element by mass %. In a case where the elements are not contained, the CEV is obtained by setting the amounts thereof to zero.

$$CEV=C+Mn/6+(Cr+Mo+V)/5+(Ni+Cu)/15 \quad (1)$$

Next, a metallographic structure of the steel H-shape for low temperature service according to the present embodiment, and the thickness and the characteristics of the flange will be described.

Figure 4:
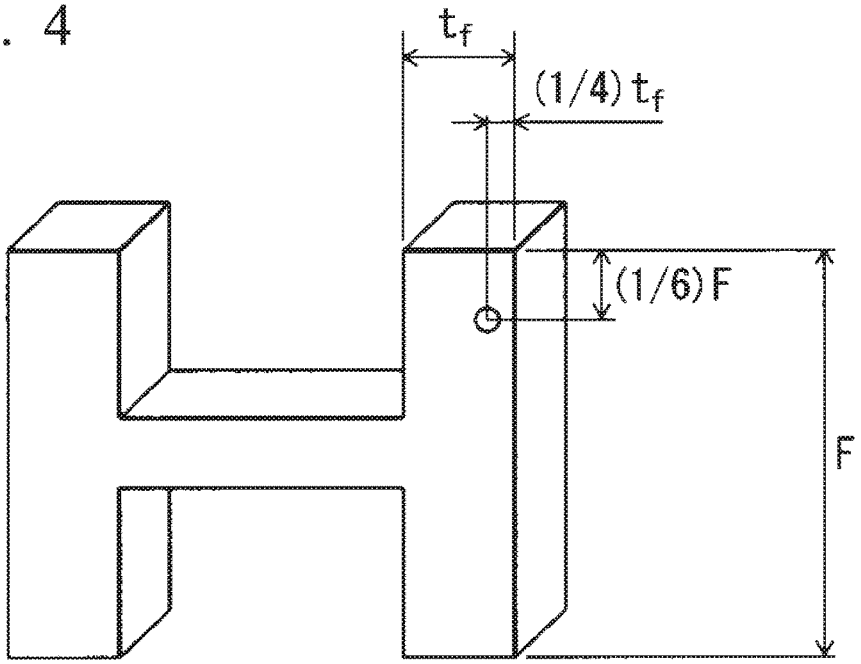
FIG. 4 is a view showing a position at which a test piece of a steel H-shape is collected.

In a case of the steel H-shape for low temperature service according to the present embodiment, the characteristics of the flange are important. Therefore, in the steel H-shape for low temperature service according to the present embodiment, the structure and the characteristics of the flange are evaluated. However, in a steel H-shape, due to its shape, the temperature is likely to fall at the time of hot rolling in an end portion of the flange and the temperature is unlikely to fall in a center portion. Accordingly, the temperature history varies depending on the position. Therefore, in the present embodiment, as shown in FIG. 4, observation of the metallographic structure of the steel H-shape and measurement of mechanical characteristics (strength, Charpy absorbed energy, and CTOD characteristics) are performed using a test piece collected at a 1/4 position ((1/4) $t_f$) from an outer side across a thickness ($t_f$) of the flange and a 1/6 position ((1/6) F) from an outer side across a flange width (F) in a cross section in a width direction of a steel H-shape, which is in the middle of the end portion of the flange of which the temperature is likely to fall at the time of hot rolling, and the center portion of which the temperature is unlikely to fall. It is assumed that average mechanical characteristics of a steel H-shape can be obtained at this position from a temperature distribution at the time of rolling. The structure and the mechanical characteristics at (¾) $t_f$ and (⅙) F is equal to that at (¼) $t_f$ and (⅙) F.

(Sum of area ratio of one or both of ferrite and bainite: 90% or more)

(Area ratio of hard phase: 10% or less)

In the metallographic structure of the steel H-shape for low temperature service according to the present embodiment, the sum of the area ratio of one or both of ferrite and bainite is 90% or more. The upper limit therefor is not particularly limited and may be 100%. In addition, there is no need to limit the area ratio of each of ferrite and bainite.

Meanwhile, the area ratio of the hard phase consisting of one or both of MA and pseudo-pearlite which cause low temperature toughness to be degraded is limited to 10% or less. The lower limit for the area ratio of the hard phase is not particularly limited and may be 0%. In the hard phase, compared to pearlite, pseudo-pearlite is in a phase in which lamellar cementite is divided or the longitudinal direction of sheet-shaped cementite is not intragranularly aligned. Since pseudo-pearlite is hard compared to pearlite, pseudo-pearlite causes low temperature toughness to be degraded.

There are cases where the steel H-shape for low temperature service according to the present embodiment includes pearlite as a remainder other than ferrite, bainite, and a hard phase.

(Effective grain size: 20.0 μm or less)

(Grain size of hard phase: 10.0 μm or less)

The effective grain size is correlated with toughness of a metallographic structure in which ferrite, bainite, pseudo-pearlite, MA, pearlite, and the like are mixed. In the steel H-shape for low temperature service according to the present embodiment, in order to ensure toughness, the effective grain size is set to 20.0 μm or less. The effective grain size is the equivalent circle diameter of a region surrounded by a large angle boundary having an orientation difference of 15° or greater.

The hard phase which becomes an origin of a fracture needs to be finer than the effective grain size, so that the grain size of the hard phase is set to 10.0 μm or less. If the grain size of the hard phase exceeds 10.0 μm, toughness is degraded.

Evaluation of the metallographic structure of the steel H-shape for low temperature service according to the present embodiment is performed using a sample collected from the position of (¼) $t_f$ and (⅙) F shown in FIG. 4 in a cross section of the steel H-shape in the width direction and using an optical microscope and an electron back scattering diffraction pattern method (EBSD).

Specifically, a region within a rectangle of 500 μm (longitudinal direction of the flange)×400 μm (thickness direction of the flange) is observed by using an optical microscope, and the sum of the area ratio of one or both of ferrite and bainite and the area ratio of the hard phase are measured. At this time, the grain size of the hard phase is also measured. The grain size of the hard phase is measured after discriminating from ferrite, bainite, and pearlite using the optical microscope. In addition, the effective grain size is obtained as the equivalent circle diameter by the EBSD while having a region surrounded by a large angle boundary constituted of an orientation difference of 15° or greater as effective grains. The effective grain size is measured by the EBSD without ferrite, bainite, the hard phase (pseudo-pearlite and MA), and the remainder (pearlite) are discriminated each other.

(Ti oxides having equivalent circle diameter ranging from 0.01 to 3.0 μm: 30 pieces or more/$mm^2$)

Figure 2:
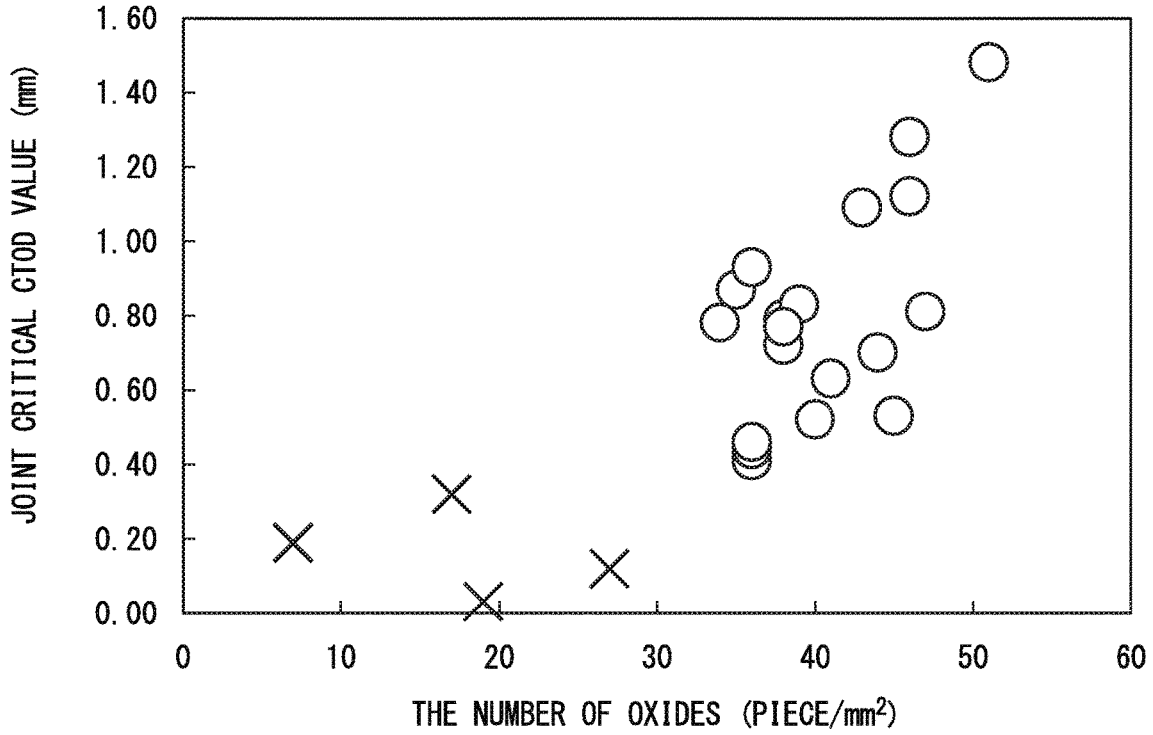
FIG. 2 is a view showing a relationship between number density of Ti oxides ranging from 0.01 to 3.0 μm and a critical CTOD value of a HAZ at −20° C.

Ti oxides having an equivalent circle diameter ranging from 0.01 to 3.0 μm become a nucleation site of intragranular ferrite. Ti oxides having an equivalent circle diameter ranging from 0.01 to 3.0 μm cause coarse austenite in the vicinity of FL to be refined by generating intragranular ferrite and suppress generation of intergranular ferrite and coarse bainite. In a case where the number density of 3 oxides ranging from 0.01 to 3.0 μm is 30 pieces or more/$mm^2$, the Charpy absorbed energy at −40° C. and −60° C. in the HAZ becomes 60 J or greater. In addition, as shown in FIG. 2, a critical CTOD value of the HAZ at −20° C. becomes 0.40 mm or greater. If Ti oxides are less than 30 pieces/$mm^2$, intragranular ferrite is insufficiently generated, so that toughness of the HAZ is degraded. Therefore, in order to ensure toughness of the HAZ, 3*i* oxides having an equivalent circle diameter ranging from 0.01 to 3.0 mun are set to be 30 pieces/$mm^2$ or more.

Within the range of the above-described composition, Ti oxides are not generated to the extent that toughness is adversely affected. Accordingly, there is no need to regulate the upper limit for the number density. However, in order to enhance toughness of the HAZ, the number density of Ti oxides having an equivalent circle diameter ranging from 0.01 to 3.0 μm is preferably 100 pieces or less/$mm^2$.

The equivalent circle diameter and the number density of Ti oxides present in a steel are measured using a sample collected from a portion similar to that in the evaluation of the metallographic structure, preparing an extraction replica, observing a region of 4 $mm^2$ or greater in the sum using a transmission electron microscope (TEM), and using an imaged photograph. In the present embodiment, Ti oxides include not only TiO, $TiO_2$, and $Ti_2O_3$ but also composite oxides of TiO, $TiO_2$, and $Ti_2O_3$ and oxides not including Ti, and a composite inclusion of Ti oxides or composite oxides and sulfides. The equivalent circle diameter of Ti oxides contributing intragranular transformation ranges from 0.01 to 3.0 μm, and there is no need to measure the number of Ti oxides having an equivalent circle diameter less than 0.01 μm or exceeding 3.0 μm.

Whether or not the observed inclusion is Ti oxides can also be determined from the shape or the like. However, it may be checked that the observed inclusion is Ti oxides by using EDS, EPMA, or the like.

(Thickness of flange: 12 to 50 mm)

The thickness of the flange of the steel H-shape for low temperature service according to the present embodiment is set to range from 12 to 50 mm. The reason is that as a steel H-shape used for a low temperature structure, a steel H-shape having a size of the thickness is 12 to 50 mm is often used. The thickness of the flange of a steel H-shape used for a low temperature structure is preferably 16 mm or greater. If the thickness of the flange exceeds 50 mm, there is a possibility that the structure will become coarse due to the insufficient reduction and a brittle fracture will be caused. The thickness of the flange is preferably 40 mm or less.

The thickness of a web generally becomes smaller than the thickness of the flange. Accordingly, the thickness of the web is preferably set to range from 8 to 40 mm. The flange/web thickness ratio is preferably set to range from 0.5 to 2.5 on the assumption of a case where the steel H-shape is manufactured through hot rolling. If the flange/web thickness ratio exceeds 2.5, the web is sometimes deformed into a waved shape. Meanwhile, in a case where the flange/web thickness ratio is less than 0.5, the flange is sometimes deformed into a waved shape.

In regard to the strength of the steel H-shape on the assumption of being used as a structural member, a normal temperature yield point (YP) or 0.2% proof stress is 335 MPa or greater, and tensile strength (TS) is 460 MPa or greater. In addition, a yield ratio (YR) is preferably 0.80 or greater.

In addition, a target value for the Charpy absorbed energy of the base metal and the welded heat-affected zone at −40° C. and −60° C. is 60 J or greater. The Charpy absorbed energy of the base metal at −40° C. and −60° C. is preferably 100 J or greater. In addition, since a structure has high reliability in the case of a high maximum value of the absorbed energy when a transition curve (curve indicating a relationship between a Charpy test temperature and absorbed energy) is prepared, toughness (Charpy absorbed energy) of a base metal at −5° C. is preferably 300 J or greater. Moreover, the target value for the critical CTOD value (amount of crack tip opening) of the base metal and the welded heat-affected zone at −20° C. is 0.40 mm or greater, and it is more preferable that a brittle fracture such as pop-in is not generated. The toughness of the welded heat-affected zone is evaluated while setting a fusion line (FL) at which the welded heat-affected zone is heated to the highest temperature and becomes coarse grains, as a notch position. As an index indicating toughness of a steel, the Charpy absorbed energy and a CTOD value indicate tendencies similar to each other. However, the correlationship therebetween is not clear, and even if the Charpy absorbed energy satisfies the target value, it is not possible to mention that the CTOD value satisfies the target value. It is determined that the steel H-shape for low temperature service according to the present embodiment has excellent low temperature toughness in the case where both the Charpy absorbed energy and the CTOD value satisfy the target value.

Figure 5:
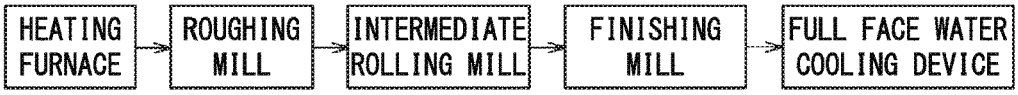
FIG. 5 is a view showing an example of a step of manufacturing a steel H-shape.

Next, a method of manufacturing a steel H-shape for low temperature service according to the present embodiment will be described. The steel H-shape for low temperature service according to the present embodiment is manufactured as follows. A slab obtained by casting a molten steel, which is melted to have a predetermined chemical composition, through continuous casting or the like is heated in a heating furnace as shown in FIG. 5. Hot rolling including rough rolling, intermediate rolling, and finish rolling is performed by using a roughing mill, an intermediate rolling mill, and a finishing mill. Then, accelerated cooling is performed by using a full face water cooling device. In the hot rolling, the rough rolling may be performed as necessary, and the rough rolling may be omitted.

Hereinafter, each step will be described.

<Melting Step>

<Casting Step>

(Oxygen content in molten steel immediately before Ti is added: 0.0015% to 0.0110%)

In a melting step and a casting step (not shown), the chemical composition of a steel (molten steel) is adjusted to the above-described range by any method, and a slab is obtained.

However, in a case where the steel H-shape for low temperature service according to the present embodiment is obtained, in order to form Ti oxides in the steel, there is a need to control the oxygen content included in the molten steel immediately before Ti is added, when the component is adjusted. In order to ensure a sufficient amount for forming Ti oxides, the oxygen content in the molten steel is set to 0.0015% or more. The oxygen content is preferably 0.0025% or more. Meanwhile, in order to ensure low temperature toughness, there is a need to suppress generation of coarse oxides. Therefore, the oxygen content in the molten steel (oxygen concentration) is limited to 0.0110% or less. The oxygen content is preferably 0.0090% or less and is more preferably 0.0080% or less. Then Ti is added, and casting is performed after the chemical composition of the molten steel is adjusted as necessary, thereby obtaining a slab. In regard to casting, from a viewpoint of productivity, continuous casting is preferably performed. In addition, from a viewpoint of productivity, the thickness of the slab is preferably set to 200 mm or more. In consideration of reduction of segregation, homogeneity of the heating temperature in hot rolling, and the like, the thickness thereof is preferably 350 mm or less.

<Hot Rolling Step>

Next, the slab is heated by using a heating furnace, and hot rolling is performed. The hot rolling includes rough rolling performed by using a roughing mill, intermediate rolling performed by using an intermediate rolling mill, and finish rolling performed by using a finishing mill. The rough rolling is a step performed as necessary before the intermediate rolling and is performed in accordance with the thickness of the slab and the thickness of a product. In addition, as the intermediate rolling, interpass water cooling rolling may be performed by using an intermediate universal rolling mill (intermediate rolling mill) and a water cooling device (not shown).

(Heating temperature of slab: 1,100° C. to 1,350° C.)

The heating temperature of the slab subjected to hot rolling is set to range from 1,100° C. to 1,350° C. If the heating temperature is low, deformation resistance increases. Accordingly, in order to ensure plasticity in the hot rolling, the heating temperature is set to 1,100° C. or more. In order to sufficiently solid-solubilize an element such as Nb which forms precipitates, the heating temperature of the slab is preferably set to 1,150° C. or more. Particularly, in the case where the thickness of a product is small, since cumulative rolling reduction becomes significant large, the heating temperature of the slab is preferably set to 1,200° C. or higher. Meanwhile, if the heating temperature of the slab exceeds 1,350° C., oxides on the surface of the slab (material) are fused and the inside of the heating furnace is damaged sometimes. Therefore, the heating temperature is set to 1,350° C. or lower. In order to have a fine structure, the heating temperature of the slab is preferably set to 1,300° C. or lower.

In the intermediate rolling of hot rolling, controlled rolling may be performed. The controlled rolling is a rolling method performed by controlling a rolling temperature and the rolling reduction. In the intermediate rolling of hot rolling, interpass water cooling rolling processing is preferably executed 1 pass or more. The interpass water cooling rolling processing is a method of rolling in which a temperature difference is caused between the surface layer area and the inside of the flange by performing water cooling between rolling passes. In the interpass water cooling rolling processing, for example, after the flange surface is water-cooled to a temperature of 700° C. or lower in the water cooling between the rolling passes, rolling is performed in a recuperating process.

In a case where the interpass water cooling rolling processing is performed, water cooling between the rolling passes is preferably performed by using water cooling devices (not shown) provided in front of and behind the intermediate universal rolling mill, and it is preferable that spray cooling on the outer surface of the flange by the water cooling devices and reverse rolling are repetitively performed. In the interpass water cooling rolling processing, even in a case where the rolling reduction is small, processing strain can be introduced to the inside across the thickness. In addition, productivity is also improved by decreasing the rolling temperature in a short period of time in water cooling.

(Finishing temperature of the hot rolling: ($Ar_3$-30°) C to 900° C.)

The finishing temperature of the hot rolling is set to range from ($Ar_3$-30)° C. to 900° C. If the finishing temperature exceeds 900° C., coarse austenite remains after rolling. If this coarse austenite is transformed into coarse bainite after cooling, the coarse bainite becomes an origin of a brittle fracture, so that toughness is degraded. The finishing temperature is preferably set to 850° C. or lower. In consideration of the shape accuracy and the like of the steel H-shape, the finishing temperature of the hot rolling is set to be equal to or higher than ($Ar_3$-30°) C which is a start temperature of ferrite transformation. $Ar_3$ can be obtained by the following Expression (2). In the following Expression (2), C, Si, Mn, Ni, Cu, Cr, and Mo each indicate an amount of the element by mass %. In a case where the elements are not contained, $Ar_3$ is obtained by setting the amounts thereof to zero.

$$Ar_3=868-396\times C+24.6\times Si-68.1\times Mn-36.1\times Ni-20.7\times Cu-24.8\times Cr+29.6\times Mo \quad (2)$$

In addition, as hot rolling, a manufacturing process in which hot rolling (primary rolling) is performed by heating a slab to a temperature ranging from 1,100° C. to 1,350° C., and after being cooled to 500° C. or lower, hot rolling (secondary rolling) is performed by heating the slab to a temperature ranging from 1,100° C. to 1,350° C. again, that is, so-called double heat rolling may be employed. In the double heat rolling, since the amount of plastic deformation per time in the hot rolling is small and the decrease in temperature in the rolling step also becomes small, the heating temperature can be lowered.

<Accelerated Cooling Step>

After the hot rolling ends, the inner surface and the outer surface of the flange of the as rolled steel are subjected to the accelerated cooling by the water cooling device (full face water cooling device) provided on the output side of the finishing mill. Air cooling is performed within a section from the finishing mill to the full face water cooling device. However, even if the start temperature of the accelerated cooling is equal to or slightly lower than the finishing temperature of the hot rolling, the characteristics are seldom affected. In addition, since the inner surface and the outer surface of the flange are subjected to the accelerated cooling, the cooling rate of the inner and outer surfaces of the flange becomes uniform, so that the material and the shape accuracy can be improved. On the upper surface of the web, the upper surface side is cooled by cooling water sprayed onto the inner surface of the flange. In order to suppress the warpage of the web, the web may be cooled from the lower surface side.

(Cooling rate of accelerated cooling: faster than 15° C./sec)

For example, the accelerated cooling of both the outer surface and the inner surface of a flange 2 of a steel H-shape 1 is performed through spray cooling by a water cooling device shown in FIG. 1 (cooling performed by cooling water 5 from a spray nozzle 4). In order to suppress coarsening of the effective grain size and generation of a hard phase constituted of one or both of pseudo-pearlite and MA, to improve toughness, and to enhance strength due to the effect of quenching, the cooling rate of the accelerated cooling is set to be faster than 15° C./sec. When the accelerated cooling is executed at the cooling rate faster than 15° C./sec and the structure is refined, even if Nb of 0.005% or more is contained, low temperature toughness can be ensured. On the other hand, since $TiO_X$ is generated in the steel H-shape for low temperature service according to the present embodiment, TiN in the steel is reduced and initial austenite is likely to be coarse. Therefore, if the accelerated cooling rate is 15 OC/sec or slower, degradation of toughness due to generation of a coarse structure becomes remarkable. The cooling rate of the accelerated cooling is preferably set to 18° C./sec or faster and is more preferably set to 20° C./sec or faster. The upper limit for the cooling rate of the accelerated cooling is not limited. However, in consideration of the shape accuracy, the upper limit is preferably 50° C./sec or slower.

Figure 7:
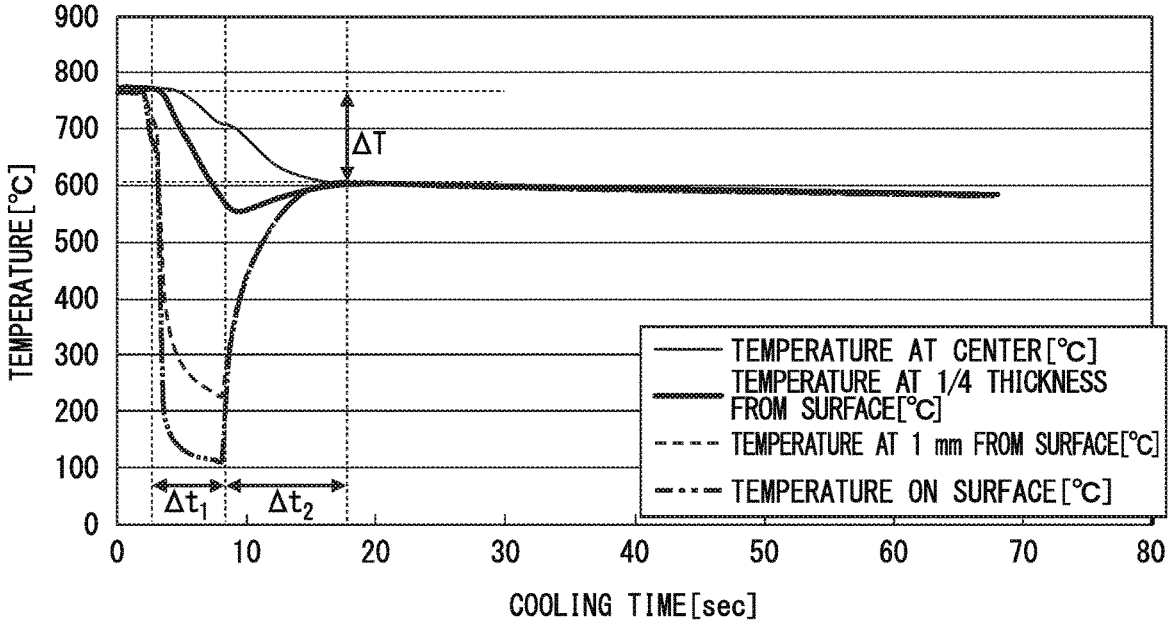
FIG. 7 is a schematic view showing an example of a cooling pattern of a flange, according to the present embodiment.

In the present embodiment, as shown in FIG. 7, the cooling rate of the accelerated cooling is calculated by dividing a temperature difference (ΔT) between the surface temperature when the accelerated cooling starts and the surface temperature after recuperating by a water cooling time ($\Delta t_1$). A time ($\Delta t_2$) from the end of water cooling to the completion of recuperating is not considered.

(Cooling stop temperature: 300° C. or lower)

The accelerated cooling is performed until the surface temperature of the steel HI-shape becomes 300° C. or lower. If the surface temperature of the steel H-shape when cooling stops (when water cooling ends) exceeds 300° C., toughness is degraded due to an increase in hard phase or coarsening of the structure.

(Highest temperature in recuperating: 350° C. to 700° C.)

Figure 3:
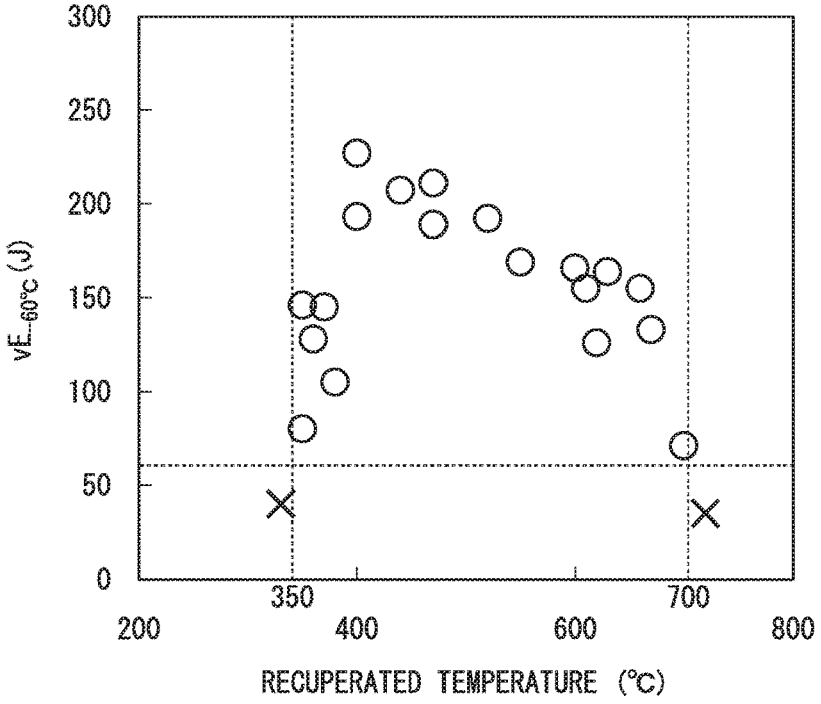
FIG. 3 is a view showing a relationship between a recuperated temperature and Charpy absorbed energy of a base metal of a steel H-shape at −60° C.

The temperature of the surface of the steel H-shape decreases fast through the accelerated cooling compared to the temperature of the inside. However, after the accelerated cooling stops, the temperature rises due to thermal conduction from the inside, thereby being equal to the internal temperature. In the present embodiment, the accelerated cooling is performed such that the maximum temperature to which the surface temperature reaches after such recuperating is controlled to a temperature within a certain range. Specifically, the accelerated cooling is performed such that the highest temperature on the surface at the 1/6 position from the outer side across the flange width after recuperating ranges from 350° C. to 700° C. If the highest temperature in recuperating exceeds 700° C., toughness is degraded due to coarsening of the effective grain size or an increase in hard phase (mainly pseudo-pearlite). Meanwhile, if the highest temperature becomes lower than 350° C., low temperature toughness is degraded due to an enhancement of strength or an increase in hard phase (mainly MA). As shown in FIG. 3, low temperature toughness of the steel H-shape (base metal) is improved when the recuperated temperature after the accelerated cooling is 350° C. to 700° C. of, so that the low temperature toughness becomes equal to or greater than 60 J which is the target.

<Heat Treatment Step>

After the accelerated cooling, heat treatment may be executed in order to adjust strength and toughness. This heat treatment may be performed at a temperature ($Ac_1$) or less at which transformation to austenite starts and is preferably performed within a range from 100° C. to 700° C. More preferably, the lower limit is set to 300° C. and the upper limit is set to 650° C. Still more preferably, the lower limit is set to 400° C. and the upper limit is set to 600° C.

Examples

Next, Example of the present invention will be described. The conditions for Example are examples of conditions employed to check the feasibility and the effect of the present invention, and the present invention is not limited to the examples of conditions. The present invention can employ various conditions as long as the object of the present invention is achieved without departing from the gist of the present invention.

Steels having the compositions shown in Table 1 and 2 were melted, and slabs having a thickness ranging from 240 to 300 mm were manufactured through continuous casting. The steels were melted by using a converter, and the amount of dissolved oxygen was adjusted. Thereafter, the component was adjusted by adding an alloy including Ti, and vacuum degassing was performed as necessary.

The obtained slabs were heated under the conditions shown in Tables 3 and 4, hot rolling was performed, and accelerated cooling was executed. The recuperated temperatures in Tables 3 and 4 denote the highest temperature in recuperating after the accelerated cooling has stopped. In the hot rolling, subsequent to rough rolling, spray cooling and reverse rolling were performed with respect to the outer surface of the flange by using an intermediate universal rolling mill and water cooling devices provided in front of and behind the intermediate universal rolling mill. The components shown in Table 1 and Table 2 were obtained by performing chemical analysis of samples collected from the manufactured steel H-shapes.

TABLE 1

| | Chemical compositions (mass %) and remainder of Fe and impurities | | | | | | | | | | | | | | | | |
|---|---|---|---|---|---|---|---|---|---|---|---|---|---|---|---|---|---|
| | C | Si | Mn | Nb | Ti | Al | N | O | V | Cu | Ni | Mo | Cr | Ca | Mg | REM | CEV |
| 1 | 0.03 | 0.18 | 1.11 | 0.051 | 0.010 | 0.005 | 0.0043 | 0.0069 | 0.06 | | | | | | | | 0.23 |
| 2 | 0.12 | 0.22 | 1.00 | 0.006 | 0.021 | 0.004 | 0.0099 | 0.0059 | 0.03 | | | | | | | | 0.29 |
| 3 | 0.06 | 0.13 | 1.56 | 0.043 | 0.018 | 0.004 | 0.0041 | 0.0032 | 0.06 | | | | | | | | 0.33 |
| 4 | 0.09 | 0.47 | 1.29 | 0.008 | 0.006 | 0.004 | 0.0015 | 0.0006 | 0.02 | | | | | | | | 0.31 |
| 5 | 0.05 | 0.11 | 0.85 | 0.038 | 0.013 | 0.005 | 0.0078 | 0.0073 | 0.06 | | | | | | | | 0.20 |
| 6 | 0.05 | 0.08 | 1.87 | 0.053 | 0.008 | 0.006 | 0.0022 | 0.0029 | 0.02 | | | | | | | 0.0009 | 0.37 |
| 7 | 0.10 | 0.27 | 1.41 | 0.030 | 0.014 | 0.004 | 0.0088 | 0.0036 | 0.03 | 0.20 | | | | | | | 0.35 |
| 8 | 0.13 | 0.06 | 1.13 | 0.044 | 0.010 | 0.005 | 0.0068 | 0.0093 | 0.05 | | 0.40 | | 0.20 | | | | 0.40 |
| 9 | 0.10 | 0.46 | 1.17 | 0.008 | 0.016 | 0.004 | 0.0039 | 0.0040 | 0.05 | | | | | | | | 0.31 |
| 10 | 0.04 | 0.39 | 1.76 | 0.059 | 0.009 | 0.003 | 0.0043 | 0.0081 | 0.03 | | | | | 0.0003 | | | 0.34 |
| 11 | 0.06 | 0.19 | 1.40 | 0.034 | 0.023 | 0.004 | 0.0098 | 0.0086 | 0.06 | | | | | | | | 0.31 |
| 12 | 0.08 | 0.40 | 1.57 | 0.034 | 0.005 | 0.004 | 0.0042 | 0.0049 | | | | | | | 0.0006 | | 0.34 |
| 13 | 0.09 | 0.22 | 1.61 | 0.008 | 0.022 | 0.006 | 0.0100 | 0.0082 | 0.05 | | | | | | | | 0.37 |
| 14 | 0.07 | 0.27 | 1.20 | 0.058 | 0.019 | 0.006 | 0.0117 | 0.0083 | 0.04 | | | 0.09 | | | | | 0.30 |

TABLE 1-continued

| | Chemical compositions (mass %) and remainder of Fe and impurities | | | | | | | | | | | | | | | | |
|---|---|---|---|---|---|---|---|---|---|---|---|---|---|---|---|---|---|
| | C | Si | Mn | Nb | Ti | Al | N | O | V | Cu | Ni | Mo | Cr | Ca | Mg | REM | CEV |
| 15 | 0.07 | 0.11 | 1.04 | 0.005 | 0.011 | 0.003 | 0.0047 | 0.0084 | 0.06 | | | | 0.19 | | | | 0.29 |
| 16 | 0.08 | 0.39 | 1.38 | 0.059 | 0.019 | 0.003 | 0.0035 | 0.0039 | | | | | | | | | 0.31 |
| 17 | 0.10 | 0.17 | 1.11 | 0.055 | 0.016 | 0.004 | 0.0022 | 0.0007 | 0.05 | | | | | | | | 0.30 |
| 18 | 0.07 | 0.29 | 1.19 | 0.034 | 0.005 | 0.004 | 0.0025 | 0.0035 | 0.02 | | | | | | | | 0.27 |
| 19 | 0.04 | 0.34 | 1.83 | 0.008 | 0.015 | 0.004 | 0.0115 | 0.0099 | 0.05 | | | | | | | 0.0002 | 0.36 |
| 20 | 0.07 | 0.11 | 1.51 | 0.034 | 0.012 | 0.002 | 0.0038 | 0.0044 | | | | | | | | | 0.32 |
| 21 | 0.06 | 0.21 | 1.79 | 0.011 | 0.011 | 0.004 | 0.0041 | 0.0031 | | | | | | | | | 0.36 |

TABLE 2

| | Chemical compositions (mass %) and remainder of Fe and impurities | | | | | | | | | | | | | | | | |
|---|---|---|---|---|---|---|---|---|---|---|---|---|---|---|---|---|---|
| | C | Si | Mn | Nb | Ti | Al | N | O | V | Cu | Ni | Mo | Cr | Ca | Mg | REM | CEV |
| 22 | 0.02 | 0.13 | 1.42 | 0.013 | 0.021 | 0.006 | 0.0048 | 0.0086 | 0.06 | | | | | | | 0.0006 | 0.27 |
| 23 | 0.15 | 0.42 | 1.33 | 0.039 | 0.012 | 0.003 | 0.0108 | 0.0041 | 0.07 | | | | | | | | 0.39 |
| 24 | 0.09 | 0.52 | 1.34 | 0.025 | 0.020 | 0.004 | 0.0055 | 0.0053 | 0.04 | | | | | | | | 0.32 |
| 25 | 0.12 | 0.47 | 0.64 | 0.021 | 0.008 | 0.005 | 0.0049 | 0.0083 | 0.04 | | | | | | | | 0.23 |
| 26 | 0.04 | 0.36 | 2.05 | 0.038 | 0.021 | 0.004 | 0.0103 | 0.0099 | 0.05 | | | | | | | | 0.39 |
| 27 | 0.04 | 0.20 | 1.49 | 0.003 | 0.014 | 0.006 | 0.0022 | 0.0049 | | | | | | | | | 0.29 |
| 28 | 0.08 | 0.18 | 1.63 | 0.065 | 0.012 | 0.003 | 0.0111 | 0.0047 | 0.03 | | | | | | 0.0001 | | 0.36 |
| 29 | 0.04 | 0.21 | 0.98 | 0.032 | 0.032 | 0.003 | 0.0105 | 0.0031 | 0.04 | | | | | | | | 0.21 |
| 30 | 0.07 | 0.08 | 1.60 | 0.025 | 0.009 | 0.004 | 0.0058 | 0.0106 | 0.02 | | | | | | | 0.0002 | 0.34 |
| 31 | 0.12 | 0.08 | 1.52 | 0.053 | 0.015 | 0.006 | 0.0128 | 0.0015 | 0.05 | | | | | | | | 0.38 |
| 32 | 0.11 | 0.23 | 1.16 | 0.018 | 0.018 | 0.003 | 0.0037 | 0.0096 | | | | | | | | | 0.30 |
| 33 | 0.05 | 0.47 | 1.97 | 0.016 | 0.024 | 0.004 | 0.0032 | 0.0005 | 0.07 | | | | | | | | 0.39 |
| 34 | 0.10 | 0.15 | 1.21 | 0.046 | 0.020 | 0.005 | 0.0100 | 0.0047 | 0.05 | | 0.70 | | | | | | 0.36 |
| 35 | 0.06 | 0.13 | 1.56 | 0.043 | 0.018 | 0.004 | 0.0041 | 0.0004 | | | | | | | | | 0.32 |
| 36 | 0.10 | 0.30 | 1.52 | 0.022 | 0.018 | 0.003 | 0.0031 | 0.0010 | | | | | | 0.0012 | | | 0.35 |
| 37 | 0.10 | 0.13 | 1.61 | 0.024 | 0.004 | 0.004 | 0.0040 | 0.0009 | 0.06 | | | | | | | | 0.38 |
| 38 | 0.11 | 0.15 | 1.51 | 0.026 | 0.018 | 0.007 | 0.0036 | 0.0010 | 0.04 | | | | | | | | 0.37 |
| 39 | 0.12 | 0.11 | 1.61 | 0.020 | 0.011 | 0.006 | 0.0044 | 0.0024 | | 0.16 | 0.17 | | | | | | 0.41 |
| 40 | 0.08 | 0.12 | 1.63 | 0.036 | 0.012 | 0.006 | 0.0054 | 0.0041 | | | | | | | | | 0.35 |
| 41 | 0.13 | 0.11 | 1.36 | 0.031 | 0.011 | 0.010 | 0.0036 | 0.0031 | | 0.12 | 0.15 | | | | | | 0.37 |

TABLE 3

| | Oxygen content in molten steel (%) | Heating temperature (° C.) | Finishing temperature (° C.) | Cooling rate (° C./s) | Cooling stop temperature (° C.) | Recuperated temperature (° C.) | Ar3 (° C.) |
|---|---|---|---|---|---|---|---|
| 1 | 0.0089 | 1350 | 810 | 19 | 260 | 400 | 785 |
| 2 | 0.0066 | 1350 | 780 | 20 | 260 | 470 | 758 |
| 3 | 0.0049 | 1350 | 880 | 21 | 250 | 350 | 741 |
| 4 | 0.0016 | 1350 | 780 | 19 | 260 | 600 | 756 |
| 5 | 0.0077 | 1300 | 780 | 17 | 280 | 630 | 793 |
| 6 | 0.0048 | 1300 | 710 | 38 | 150 | 470 | 723 |
| 7 | 0.0063 | 1300 | 800 | 19 | 260 | 350 | 735 |
| 8 | 0.0098 | 1250 | 720 | 30 | 200 | 700 | 722 |
| 9 | 0.0054 | 1200 | 820 | 19 | 260 | 440 | 760 |
| 10 | 0.0093 | 1200 | 900 | 16 | 280 | 660 | 742 |
| 11 | 0.0101 | 1200 | 790 | 21 | 250 | 370 | 754 |
| 12 | 0.0072 | 1200 | 780 | 19 | 260 | 670 | 739 |
| 13 | 0.0106 | 1200 | 770 | 22 | 250 | 620 | 728 |
| 14 | 0.0091 | 1200 | 750 | 24 | 210 | 520 | 768 |
| 15 | 0.0109 | 1150 | 810 | 24 | 210 | 380 | 767 |
| 16 | 0.0049 | 1100 | 810 | 20 | 260 | 610 | 752 |
| 17 | 0.0023 | 1100 | 840 | 17 | 280 | 360 | 757 |
| 18 | 0.0043 | 1100 | 820 | 21 | 250 | 400 | 766 |
| 19 | 0.0109 | 1100 | 790 | 27 | 220 | 550 | 736 |
| 20 | 0.0054 | 1300 | 790 | 22 | 180 | 460 | 740 |
| 21 | 0.0064 | 1200 | 800 | 21 | 190 | 450 | 728 |

TABLE 4

| | Oxygen content in molten steel (%) | Heating temperature (° C.) | Finishing temperature (° C.) | Cooling rate (° C./s) | Cooling stop temperature (° C.) | Recuperated temperature (° C.) | Ar3 (° C.) |
|---|---|---|---|---|---|---|---|
| 22 | 0.0092 | 1350 | 830 | 20 | 260 | 700 | 767 |
| 23 | 0.0050 | 1350 | 870 | 20 | 250 | 500 | 728 |
| 24 | 0.0079 | 1350 | 810 | 21 | 220 | 560 | 754 |
| 25 | 0.0086 | 1350 | 850 | 18 | 210 | 600 | 788 |
| 26 | 0.0108 | 1300 | 760 | 23 | 240 | 700 | 721 |
| 27 | 0.0067 | 1250 | 750 | 17 | 280 | 480 | 756 |
| 28 | 0.0058 | 1250 | 860 | 21 | 250 | 450 | 730 |
| 29 | 0.0037 | 1250 | 850 | 18 | 270 | 700 | 791 |
| 30 | 0.0133 | 1250 | 790 | 22 | 250 | 510 | 733 |
| 31 | 0.0035 | 1250 | 880 | 18 | 260 | 660 | 719 |
| 32 | 0.0104 | 1200 | 870 | 18 | 240 | 720 | 751 |
| 33 | 0.0019 | 1200 | 770 | 14 | 320 | 630 | 726 |
| 34 | 0.0075 | 1200 | 920 | 16 | 260 | 380 | 724 |
| 35 | 0.0021 | 1200 | 880 | 21 | 250 | 570 | 741 |
| 36 | 0.0029 | 1100 | 800 | 21 | 250 | 600 | 732 |
| 37 | 0.0019 | 1100 | 800 | 21 | 210 | 470 | 722 |
| 38 | 0.0012 | 1100 | 780 | 23 | 210 | 380 | 725 |
| 39 | 0.0031 | 1200 | 800 | 19 | 260 | 460 | 704 |
| 40 | 0.0055 | 1200 | 820 | 16 | 280 | 340 | 728 |
| 41 | 0.0051 | 1200 | 820 | 19 | 260 | 460 | 719 |

As shown in FIG. 4, the test pieces having a rolling direction as a length direction were collected at a ¼ position ((¼) $t_f$) from the outer side across the thickness ($t_f$) of the flange and a ⅙ position ((⅙) F) from the outer side across the flange width (F) in a cross section in the width direction of the steel H-shape, and the mechanical characteristics were measured. As the mechanical characteristics, the yield point (YP), the tensile strength (TS), and the Charpy absorbed energy at −5° C., −40° C., and −60° C. (respectively $vE_{-5° C.}$, $vE_{-40° C.}$, $vE_{-60° C.}$) were measured. The tensile test was performed at a normal temperature in conformity to JIS Z 2241, and the Charpy impact test was performed at −5° C., −40° C., and −60° C. in conformity to JIS Z 2242.

In addition, the samples were collected from the position at which the test pieces used for measuring the mechanical characteristics were collected. The metallographic structure in a region within a rectangle of 500 μm (longitudinal direction)×400 μm (thickness direction of the flange) was observed by using an optical microscope. Then, the sum of the area ratio of one or both of ferrite and bainite, and the area ratio of the hard phase and the grain size were measured. It was also checked that the remainder was pearlite by observing the metallographic structure. The effective grain size was measured by the EBSD. The number of Ti oxides having an equivalent circle diameter ranging from 0.01 to 3.0 μm was measured in a region of 4 $mm^2$ or greater using samples collected from a portion similar to that in the evaluation of the metallographic structure, preparing extraction replicas, and using the TEM.

Next, CTOD test pieces were prepared, and the critical CTOD value (amount of crack tip opening) of the steel H-shape (base metal) at −20° C. was measured. The CTOD test pieces were prepared by cutting out a flange portion in full thickness, preparing smooth test pieces, and having the notch position on an extended line of the original web surface. The test method followed BS7448.

Figure 6A:
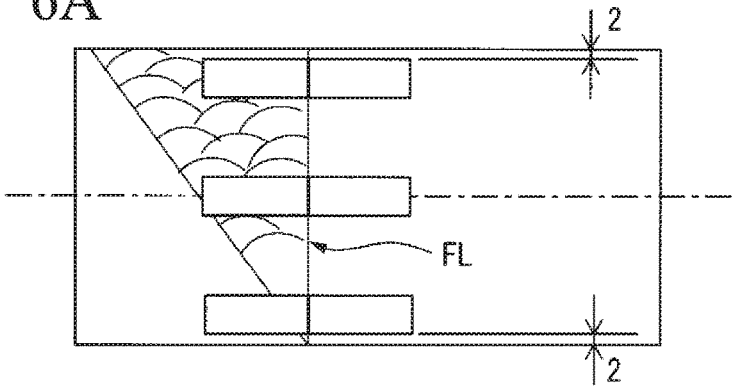
FIG. 6A is a view showing a notch position when a Charpy impact test piece of a weld is collected.
Figure 6B:
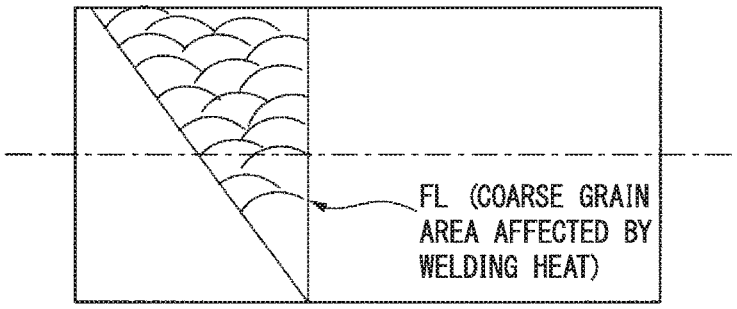
FIG. 6B is a view showing a notch position when a CTOD test piece of a weld is collected.

In addition, the CTOD value and the Charpy absorbed energy of the welded heat-affected zone were measured by the following method. The collecting position of the test pieces followed EN10225. First, the flange portion of the steel H-shape (base metal) was cut out, a single bevel groove was provided, and submerged arc welding was performed with a weld heat input 35 kJ/cm. Then, in a bonding portion of the bevel groove on the perpendicular side, test pieces having FL shown in FIG. 6A as the notch position were collected, and the Charpy impact test was performed. The CTOD test was performed by collecting the test pieces such that the notch position becomes FL as shown in FIG. 6B. Then, similar to the test of the base metal, the Charpy absorbed energy at −40° C. and 60° C. and the critical CTOD value (amount of crack tip opening) at −20° C. of the welded heat-affected zone were measured. In this way, toughness of a coarse grain area affected by welding heat was evaluated while having FL heated to the highest temperature as the notch position.

Tables 5 and 6 show the result. As the target values for the characteristics of the steel H-shape, the normal temperature yield point (YP) or 0.2% proof stress was 335 MPa or greater, the tensile strength (TS) ranged from 460 to 620 MPa, the Charpy absorbed energy at both −40° C. and −60° C. was 60 J or greater, and the CTOD value at −20° C. was 0.40 mm or greater. The target value for the Charpy absorbed energy and the CTOD value of the welded heat-affected zone was the same as that of the base metal.

TABLE 5

| | Flange thickness (mm) | Area ratio (%) | | Number of $TiO_x$ (pieces/$mm^2$) | Grain size (μm) | | Strength (MPa) | | Toughness of base metal | | | | Toughness of HAZ | | |
|---|---|---|---|---|---|---|---|---|---|---|---|---|---|---|---|
| | | Ferrite + bainite | Hard phase | | Effective grain size | Hard phase | YP | TS | $vE_{-5° C.}$ (J) | $vE_{-40° C.}$ (J) | $vE_{-60° C.}$ (J) | δ (mm) | $vE_{-40° C.}$ (J) | $vE_{-60° C.}$ (J) | δ (mm) |
| 1 | 50 | 94.5 | 5.3 | 38 | 7.2 | 8.1 | 372 | 490 | 321 | 212 | 193 | 0.79 | 194 | 182 | 0.79 |
| 2 | 44 | 93.3 | 6.2 | 35 | 14.3 | 7.1 | 492 | 584 | 328 | 203 | 189 | 1.47 | 188 | 173 | 0.87 |

TABLE 5-continued

| | Flange thickness (mm) | Area ratio (%) Ferrite + bainite | Area ratio (%) Hard phase | Number of $TiO_x$ (pieces/mm$^2$) | Grain size (μm) Effective grain size | Grain size (μm) Hard phase | Strength (MPa) YP | Strength (MPa) TS | Toughness of base metal $vE_{-5° C.}$ (J) | Toughness of base metal $vE_{-40° C.}$ (J) | Toughness of base metal $vE_{-60° C.}$ (J) | Toughness of base metal δ (mm) | Toughness of HAZ $vE_{-40° C.}$ (J) | Toughness of HAZ $vE_{-60° C.}$ (J) | Toughness of HAZ δ (mm) |
|---|---|---|---|---|---|---|---|---|---|---|---|---|---|---|---|
| 3 | 28 | 95.4 | 3.5 | 36 | 9.1 | 3.8 | 353 | 572 | 362 | 156 | 146 | 0.70 | 150 | 86 | 0.41 |
| 4 | 28 | 91.1 | 7.9 | 36 | 17.4 | 9.1 | 431 | 531 | 354 | 170 | 166 | 0.95 | 143 | 120 | 0.44 |
| 5 | 28 | 95.7 | 3.5 | 40 | 11.4 | 5.4 | 415 | 512 | 354 | 179 | 164 | 1.09 | 164 | 162 | 0.52 |
| 6 | 40 | 92.3 | 6.3 | 51 | 12.3 | 7.5 | 391 | 502 | 332 | 229 | 211 | 1.42 | 209 | 157 | 1.48 |
| 7 | 40 | 91.6 | 6.1 | 36 | 9.0 | 7.8 | 454 | 548 | 384 | 99 | 80 | 1.03 | 81 | 65 | 0.93 |
| 8 | 32 | 92.0 | 7.1 | 44 | 15.0 | 9.5 | 460 | 561 | 400 | 81 | 71 | 0.67 | 74 | 65 | 0.70 |
| 9 | 32 | 91.1 | 7.6 | 41 | 12.4 | 9.9 | 456 | 562 | 342 | 217 | 207 | 0.88 | 189 | 177 | 0.63 |
| 10 | 36 | 94.2 | 4.3 | 36 | 18.2 | 5.2 | 356 | 478 | 357 | 170 | 155 | 0.72 | 148 | 102 | 0.46 |
| 11 | 36 | 93.2 | 6.3 | 47 | 10.3 | 8.1 | 422 | 531 | 346 | 161 | 145 | 1.41 | 151 | 113 | 0.81 |
| 12 | 40 | 92.1 | 6.1 | 34 | 11.3 | 7.3 | 418 | 533 | 356 | 140 | 133 | 1.44 | 122 | 97 | 0.78 |
| 13 | 40 | 90.1 | 9.2 | 43 | 16.1 | 9.2 | 356 | 519 | 354 | 145 | 126 | 1.41 | 123 | 79 | 1.09 |
| 14 | 40 | 92.4 | 6.6 | 45 | 12.7 | 9.2 | 417 | 489 | 331 | 193 | 192 | 0.89 | 182 | 150 | 0.53 |
| 15 | 36 | 95.7 | 4.1 | 38 | 13.4 | 4.4 | 471 | 611 | 396 | 120 | 105 | 0.72 | 118 | 92 | 0.72 |
| 16 | 28 | 92.0 | 7.3 | 46 | 10.6 | 9.8 | 382 | 489 | 349 | 164 | 155 | 1.33 | 136 | 106 | 1.28 |
| 17 | 12 | 92.7 | 4.5 | 39 | 10.8 | 4.8 | 429 | 543 | 376 | 130 | 128 | 1.01 | 107 | 81 | 0.83 |
| 18 | 12 | 91.1 | 7.9 | 38 | 11.5 | 7.1 | 400 | 511 | 309 | 239 | 227 | 1.21 | 216 | 172 | 0.77 |
| 19 | 12 | 91.5 | 7.5 | 46 | 13.5 | 7.6 | 394 | 513 | 370 | 176 | 169 | 1.60 | 158 | 119 | 1.12 |
| 20 | 32 | 100.0 | 0.0 | 39 | 10.1 | — | 399 | 491 | 388 | 381 | 377 | 1.41 | 311 | 261 | 1.21 |
| 21 | 32 | 99.5 | 0.5 | 41 | 12.1 | 1.2 | 421 | 531 | 361 | 311 | 301 | 1.12 | 211 | 200 | 0.87 |

TABLE 6

| | Flange thickness (mm) | Area ratio (%) Ferrite + bainite | Area ratio (%) Hard phase | Number of $TiO_x$ (pieces/mm$^2$) | Grain size (μm) Effective grain size | Grain size (μm) Hard phase | Strength (MPa) YP | Strength (MPa) TS | Toughness of base metal $vE_{-5° C.}$ (J) | Toughness of base metal $vE_{-40° C.}$ (J) | Toughness of base metal $vE_{-60° C.}$ (J) | Toughness of base metal δ (mm) | Toughness of HAZ $vE_{-40° C.}$ (J) | Toughness of HAZ $vE_{-60° C.}$ (J) | Toughness of HAZ δ (mm) |
|---|---|---|---|---|---|---|---|---|---|---|---|---|---|---|---|
| 22 | 50 | 94.4 | 4.5 | 44 | 15.5 | 4.8 | 314 | 435 | 331 | 226 | 220 | 1.28 | 197 | 239 | 0.98 |
| 23 | 44 | 85.4 | 12.1 | 39 | 17.5 | 11.1 | 477 | 571 | 211 | 52 | 32 | 0.39 | 25 | 31 | 0.25 |
| 24 | 40 | 87.1 | 12.3 | 38 | 12.0 | 12.1 | 378 | 486 | 221 | 57 | 49 | 0.05 | 43 | 31 | 0.04 |
| 25 | 40 | 91.1 | 7.1 | 42 | 23.1 | 6.1 | 311 | 409 | 210 | 46 | 45 | 0.15 | 41 | 42 | 0.09 |
| 26 | 36 | 93.4 | 4.4 | 41 | 9.1 | 5.9 | 441 | 611 | 261 | 46 | 32 | 0.14 | 40 | 14 | 0.01 |
| 27 | 32 | 93.8 | 4.3 | 43 | 21.1 | 5.5 | 319 | 394 | 111 | 57 | 41 | 0.29 | 35 | 17 | 0.11 |
| 28 | 36 | 87.3 | 11.2 | 40 | 15.6 | 8.6 | 415 | 554 | 121 | 59 | 52 | 0.09 | 33 | 42 | 0.04 |
| 29 | 32 | 95.5 | 2.2 | 35 | 17.9 | 1.5 | 458 | 585 | 190 | 44 | 28 | 0.35 | 32 | 17 | 0.23 |
| 30 | 28 | 92.2 | 5.4 | 34 | 13.7 | 6.8 | 358 | 467 | 289 | 57 | 38 | 0.12 | 39 | 21 | 0.11 |
| 31 | 28 | 92.5 | 6.1 | 39 | 19.1 | 8.1 | 403 | 513 | 110 | 34 | 25 | 0.21 | 18 | 3 | 0.05 |
| 32 | 25 | 87.8 | 11.7 | 45 | 23.1 | 11.1 | 303 | 435 | 251 | 55 | 35 | 0.26 | 41 | 38 | 0.21 |
| 33 | 25 | 88.6 | 11.0 | 39 | 22.9 | 12.8 | 324 | 457 | 199 | 41 | 32 | 0.39 | 30 | 39 | 0.31 |
| 34 | 16 | 90.3 | 7.4 | 42 | 21.2 | 10.0 | 400 | 475 | 212 | 54 | 49 | 0.11 | 38 | 42 | 0.06 |
| 35 | 12 | 91.2 | 7.7 | 27 | 16.1 | 7.1 | 368 | 478 | 222 | 187 | 178 | 1.60 | 56 | 42 | 0.12 |
| 36 | 32 | 90.8 | 9.1 | 19 | 11.4 | 2.1 | 411 | 514 | 267 | 191 | 179 | 1.44 | 53 | 24 | 0.03 |
| 37 | 12 | 90.7 | 8.4 | 7 | 14.7 | 3.8 | 453 | 598 | 121 | 97 | 95 | 0.58 | 48 | 22 | 0.19 |
| 38 | 12 | 92.9 | 5.3 | 17 | 12.9 | 7.8 | 361 | 489 | 281 | 234 | 218 | 1.74 | 31 | 6 | 0.32 |
| 39 | 32 | 89.1 | 10.2 | 32 | 9.2 | 6.1 | 441 | 601 | 150 | 121 | 108 | 0.36 | 51 | 41 | 0.22 |
| 40 | 12 | 89.5 | 10.3 | 41 | 9.3 | 3.1 | 399 | 610 | 250 | 32 | 21 | 0.11 | 181 | 164 | 0.84 |
| 41 | 32 | 92.1 | 6.8 | 28 | 11.2 | 2.1 | 403 | 551 | 357 | 189 | 131 | 1.22 | 31 | 11 | 0.23 |

As shown in Table 5, in No. 1 to 21 which are examples of the present invention, 0.2% proof stress (YP) at a normal temperature was high, the tensile strength (TS) was within the range of the target value, and the Charpy absorbed energy and the critical CTOD value sufficiently satisfied the target in both the base metal and the welded heat-affected zone.

On the other hand, as shown in Table 6, No. 22 had insufficient strength due to the small amount of C. No. 23 had a large amount of C, No. 24 had a large amount of Si, and No. 39 had a high CEV, so that toughness was degraded due to an increase in hard phase and coarsening. No. 25 had a small amount of Mn. No. 27 had a small amount of Nb, so that the effective grain size increased and strength and toughness were degraded. No. 26, 29, 30 and 31 had a large amount of Mn, Ti, O, and N respectively, so that toughness was degraded due to an inclusion. No. 28 had a large amount of Nb, and an increase in hard phase and/or an enhancement of hardness was caused in accordance with improvement of hardenability, so that toughness was degraded. No. 35 had a small amount of O (oxygen), and $TiO_X$ was not sufficiently generated, so that toughness of a joint was degraded. No. 36 had excessive Ca. No. 37 had insufficient Ti, and No. 41 had excessive Al. Since $TiO_X$ was not sufficiently generated in all of No. 36, 37, and 41, toughness of the joint was degraded. No. 38 had a small amount of oxygen included in the molten steel immediately before Ti is added in the steel manufacturing step, and $TiO_X$ was not sufficiently generated, so that toughness of the joint was degraded.

No. 32 had a high accelerated cooling stop temperature. No. 33 had a large effective grain size due to the slow cooling rate, so that strength and toughness were degraded. No. 34 was an example having a high finishing temperature, and toughness was degraded. No. 40 had a low recuperated temperature, and the hard phase increased, so that toughness of the base metal was degraded.

INDUSTRIAL APPLICABILITY

For example, a steel H-shape of the present invention is suitable for a floating production, storage and offloading system (FPSO), that is, facilities or the like which produce petroleum and gas on the ocean, store products in a tank within the facilities, and directly perform offloading to a transporting tanker.

BRIEF DESCRIPTION OF THE REFERENCE SYMBOLS

1 steel H-shape
2 flange
3 web
4 spray nozzle
5 cooling water

What is claimed is:

1. A steel H-shape comprising, by mass %,
C: 0.05% to 0.13%,
Mn: 0.80% to 2.00%,
Nb: 0.011% to 0.060%,
Ti: 0.005% to 0.025%,
O: 0.0005% to 0.0100%.
V: 0% to 0.08%,
Cu: 0% to 0.40%,
Ni: 0% to 0.70%,
Mo: 0% to 0.10%,
Cr: 0% to 0.20%,
Si: limited to 0.50% or less,
Al: limited to 0.008% or less,
Ca: limited to 0.0010% or less,
REM: limited to 0.0010% or less,
Mg: limited to 0.0010% or less,
N: limited to 0.0120% or less, and
a remainder including Fe and impurities,
wherein a CEV obtained b the following Expression (1) is 0.40 or less,
wherein at a ¼ position from an outer side across a thickness of a flange and a ⅙ position from an outer side across a flange width, a sum of an area ratio of one or both of ferrite and bainite is 90% or more, and an area ratio of a hard phase consisting of one or both of MA and pseudo-pearlite is 10% or less,
wherein an effective grain size is 20.0 μm or less, and a grain size of the hard phase is 10.0 μm or less,
wherein Charpy absorbed energy at −40° C. is 60 J or greater,
wherein 30 pieces/mm$^2$ or more Ti oxides having an equivalent circle diameter ranging from 0.01 to 3.0 μm are included, and
wherein a thickness of the flange is 12 to 50 mm, $$CEV=C+Mn/6+(Cr+Mo+V)/5+(Ni+Cu)/15 \quad (1)$$

where, C, Mn, Cr, Mo, V, Ni, and Cu each indicate an amount of the element by mass %.

2. The steel H-shape according t comprising, by mass %, one or two or more selected from the group consisting of
V: 0.01% to 0.08%,
Cu: 0.01% to 0.40%,
Ni: 0.01% to 0.70%,
Mo: 0.01% to 0.10%, and
Cr: 0.01% to 0.20%.

3. A method of manufacturing the steel H-shape according to claim 1, the method comprising:
melting a steel including the same chemical composition as that of the steel H-shape according to claim 1;
casting the steel obtained through the melting to obtain a slab;
heating the slab to a temperature ranging from 1,100° C. to 1,350° C., and then performing hot rolling at a finishing temperature ranging from ($Ar_3$-30)° C. to 900° C. to obtain a steel H-shape; and
performing an accelerated cooling of the steel H-shape, in which inner and outer surfaces of a flange are subjected to water cooling at a cooling rate exceeding 15° C./sec,
wherein in the melting, Ti is added after oxygen concentration of a molten steel immediately before addition of the Ti is adjusted to a range from 0.0015 to 0.0110 mass %, and
wherein in the accelerated cooling, the water cooling is performed such that a cooling stop temperature at a ⅙ position from an outer side across a flange width of the steel H-shape is 300° C. or lower at a surface temperature, and a maximum temperature of the surface temperature after recuperating is 350° C. to 700° C.

4. A method of manufacturing the steel H-shape according to claim 2, the method comprising:
melting a steel including the same chemical composition as that of the steel H-shape according to claim 2; casting the steel obtained through the melting to obtain a slab; heating the slab to a temperature ranging from 1,100° C. to 1,350° C., and then performing hot rolling at a finishing temperature ranging from ($Ar_3$-30)° C. to 900° C. to obtain a steel H-shape; and
performing an accelerated cooling of the steel H-shape, in which inner and outer surfaces of a flange are subjected to water cooling at a cooling rate exceeding 15° C./sec,
wherein in the melting, Ti is added after oxygen concentration of a molten steel immediately before addition of the Ti is adjusted to a range from 0.0015 to 0.0110 mass %, and
wherein in the accelerated cooling, the water cooling is performed such that a cooling stop temperature at a ⅙ position from an outer side across a flange width of the steel H-shape is 300° C. or lower at a surface temperature, and a maximum temperature of the surface temperature after recuperating is 350° C. to 700° C.

* * * * *